US012612216B2

(12) United States Patent
Carespodi et al.

(10) Patent No.: US 12,612,216 B2
(45) Date of Patent: Apr. 28, 2026

(54) INDUCTION HEAT SEALABLE CLOSURE LINER OR LIDDING CONFIGURED FOR PAPER RECYCLING STREAM

(71) Applicant: Tekni-Plex, Inc., Wayne, PA (US)

(72) Inventors: Dennis Carespodi, Winston-Salem, NC (US); Munish Shah, Sylvania, OH (US)

(73) Assignee: Tekni-Plex, Inc., Wayne, PA (US)

( * ) Notice: Subject to any disclaimer, the term of this patent is extended or adjusted under 35 U.S.C. 154(b) by 290 days.

(21) Appl. No.: 18/386,761

(22) Filed: Nov. 3, 2023

(65) Prior Publication Data

US 2025/0145339 A1 May 8, 2025

(51) Int. Cl.
*B65D 41/04* (2006.01)
*B65D 53/04* (2006.01)

(52) U.S. Cl.
CPC ..... *B65D 41/045* (2013.01); *B65D 53/04* (2013.01)

(58) Field of Classification Search
CPC ..... B65D 41/045; B65D 53/04; B32B 15/12; B32B 27/10; D21H 19/04; D21H 27/10
See application file for complete search history.

(56) References Cited

U.S. PATENT DOCUMENTS

| | | | |
|---|---|---|---|
| 2,073,415 | A | 3/1937 | Enkur |
| 4,596,338 | A | 6/1986 | Yousif |
| 5,381,913 | A | 1/1995 | Peeters |
| 5,712,042 | A | 1/1998 | Cain |
| 6,277,478 | B1 | 8/2001 | Kurita et al. |
| 11,370,587 | B2 | 6/2022 | Shi |
| 2006/0057315 | A1 | 3/2006 | De Coninck et al. |
| 2008/0073308 | A1 | 3/2008 | Yousif |
| 2014/0227400 | A1 | 8/2014 | Farooqui |

(Continued)

FOREIGN PATENT DOCUMENTS

| | | | |
|---|---|---|---|
| CN | 106829187 | A | 6/2017 |
| EP | 4101631 | A1 | 12/2022 |
| EP | 3821074 | B1 | 1/2023 |

(Continued)

OTHER PUBLICATIONS

The Notification of Transmittal of the International Preliminary Report on Patentability from the counterpart application issued on Jul. 29, 2025, PCT Application No. PCT/US2024/053555.

(Continued)

*Primary Examiner* — Michael C Miggins
(74) *Attorney, Agent, or Firm* — POLSINELLI PC

(57) ABSTRACT

The liner of the present invention provides a simple, cost-effective solution that will allow consumers to recycle the entire liner in a paper recycling stream. As a result, manufacturers currently selling products without liners will now be able to include liners on their containers and provide a totally recyclable container package, including the container, cap and liner (each recyclable in a respective plastic or paper recycling stream), while providing the benefits that liners provide, including maintaining product integrity and barrier properties, extending shelf life, providing tamper evidence, preventing leakage, preventing products from being contaminated and/or damaged by consumers sampling the products, and/or otherwise creating an un-saleable product due to leakage, contamination or damage.

20 Claims, 6 Drawing Sheets

(56) References Cited

U.S. PATENT DOCUMENTS

| | | | | |
|---|---|---|---|---|
| 2020/0277114 | A1* | 9/2020 | Shi | B32B 7/12 |
| 2021/0171255 | A1 | 6/2021 | Shi | |

FOREIGN PATENT DOCUMENTS

| | | | |
|---|---|---|---|
| EP | 4194359 | A1 | 6/2023 |
| FR | 2560155 | A1 | 8/1985 |
| FR | 2693986 | A1 | 1/1994 |
| WO | 2020/152292 | A1 | 7/2020 |

OTHER PUBLICATIONS

International Search Report and Written Opinion from the counterpart application issued on Feb. 14, 2025, Application No. PCT/US2024/053555.

* cited by examiner

White Paperboard backed Foil Seal Liner

| | **White Paper - 85 wt.% or more** | **Non paper 15 wt.% or less (non paper contaminant when repulping)** | | |
|---|---|---|---|---|
| **Basis Weight Range** | 85 wt.% or more of white paperboard required to yield a min. of 80 wt.% upon repulping | Al foil | Solvent-based Heat Sealant Coating | Lamination Adhesive |
| **Low** | 90 lbs./ream | 10 lbs./ream | 2.5 lbs./ream | 1 lbs./ream |
| **High** | 350 lbs./ream | 55 lbs./ream | 4 lbs./ream | 2 lbs./ream |

Brown Paperboard backed Foil Seal Liner

| | **Brown Paper - 90 wt.% or more** | **Non paper 10 wt.% or less (non paper contaminant when repulping)** | | |
|---|---|---|---|---|
| **Basis Weight Range** | 90 wt.% or more of brown paperboard required to yield a min of 85 wt.% upon repulping | Al foil | Solvent-based Heat Sealant Coating | Lamination Adhesive |
| **Low** | 150 lbs./ream | 10 lbs./ream | 2.5 lbs./ream | 1 lbs./ream |
| **High** | 550 lbs./ream | 55 lbs./ream | 4 lbs./ream | 2 lbs./ream |

FIG. 5

White Paperboard backed Foil Seal Liner

| | **White Paper 85 wt.% or more** | **Non paper 15 wt.% or less (non paper contaminant when repulping)** | | |
|---|---|---|---|---|
| **Basis Weight Range** | 85 wt.% or more of white paperboard required to yield a min. of 80 wt.% upon repulping | Al foil | Resin-based Heat Sealant Coating | Lamination Adhesive |
| **Low** | 185 lbs./ream | 10 lbs./ream | 14 lbs./ream | 1 lbs./ream |
| **High** | 440 lbs./ream | 55 lbs./ream | 20 lbs./ream | 2 lbs./ream |

Brown Paperboard backed Foil Seal Liner

| | **Brown Paper 90 wt.% or more** | **Non paper 10 wt.% or less (non paper contaminant when repulping)** | | |
|---|---|---|---|---|
| **Basis Weight Range** | 90 wt.% or more of brown paperboard required to yield a min of 85 wt.% upon repulping | Al foil | Resin-based Heat Sealant Coating | Lamination Adhesive |
| **Low** | 295 lbs./ream | 10 lbs./ream | 14 lbs./ream | 1 lbs./ream |
| **High** | 695 lbs./ream | 55 lbs./ream | 20 lbs./ream | 2 lbs./ream |

FIG. 6

WARING BLENDER SPECIAL PROPELLER

INDUCTION HEAT SEALABLE CLOSURE LINER OR LIDDING CONFIGURED FOR PAPER RECYCLING STREAM

FIELD OF THE INVENTION

The present invention relates to an induction heat sealable closure liner or lidding that is configured to be fully recyclable in a paper recycling stream.

BACKGROUND OF THE INVENTION

Liners or seals have been used on containers for many years to prevent leakage or contamination and to increase the shelf life of the substance or product held within the container. For example, liners are used on containers for cosmetics, foods, drinks, medicines and other items in the form of liquids, creams, gels, particulates, powders and other substances. Liners for this purpose are typically placed over the opening on the container or, in some instances, within the cap on the container before placing the combined cap and liner over the opening (mouth) of the container.

It is common practice to attach the liner to the mouth (surrounding the opening) of the container by the process of induction heat sealing. This requires that a metal foil layer be present in the liner structure to transfer heat to a lowermost heat sealant layer for bonding the liner to the container mouth. The bonding is temporary, allowing the customer (user) to remove the liner by peeling it off the mouth of the container. The liner thus serves multiple purposes, providing a tamper-proof seal, as well as preventing leakage, contamination, or spoilage of the product in the container.

Induction heat seal liners require a metal layer for heat transfer, and in prior art liners this metal layer prevents recycling of the liner in a paper or plastic recycling stream. The heat sealant and the use of various types of plastic film or resin extruded layer(s) and other layers in the liners such as coatings and wax in a mixed composite structure, also prevents recycling of the liner in a single recycling stream. As a result, the liners generate non-recyclable trash even if the cap and/or container can be recycled. Also, prior art liners may delaminate during the peeling step, leaving residue of the liner on either or both of the cap and/or container, further impeding recycling of these structures.

Thus it would be desirable to provide a fully recyclable induction heat sealable liner or lidding structure, suitable to recycling in a paper recycling stream, while also providing the desired characteristics of providing tamper evidence, barrier properties to resist spoilage of the product, and leak resistance, while resisting delamination during removal from the container mouth.

SUMMARY OF THE INVENTION

The liner of the present invention provides a simple, cost-effective solution that will allow consumers to recycle the entire liner in a paper recycling stream. As a result, manufacturers currently selling products without liners will now be able to include liners on their containers and provide a totally recyclable container package, including the container, cap and liner (each recyclable in a respective plastic or paper recycling stream), while providing the benefits that liners provide, including maintaining product integrity and barrier properties, extending shelf life, providing tamper evidence, preventing leakage, preventing products from being contaminated and/or damaged by consumers sampling the products, and/or otherwise creating an un-saleable product due to leakage, contamination or damage.

In one embodiment of the invention, an induction heat-sealable closure liner or lidding configured for recycling in a paper recycling stream, the liner or lidding having a composite layer structure comprising: a paperboard layer; a metal foil layer for inductive heating; and a heat sealant coating; wherein the paperboard layer is white paperboard or brown paperboard, for white paperboard the paperboard layer has a pulp weight of at least 85% by weight based on the total weight of the composite layer structure, and for brown paperboard the paperboard layer has a pulp weight of at least 90% by weight based on the total weight of the composite layer structure, the remaining weight percent comprising the metal foil layer and heat sealant coating are configured for repulping of the composite layer structure to achieve a pulp yield of at least 80% by weight of the paperboard layer for white paperboard and at least 85% for brown paperboard, such that the total composite layer structure is recyclable in a paper recycling stream.

In one embodiment of the invention, the heat sealant layer comprises one or more of: a solvent-based heat sealant coating, a water-based heat sealant coating, or a resin-based heat sealant coating that is melted to form the coating.

In one embodiment of the invention, the heat sealant coating is a solvent-based heat sealant coating having a basis weight in a range of 2.5 to 4 pounds per ream where a ream comprises 3000 square feet.

In one embodiment of the invention, the heat sealant coating is a resin-based heat sealant coating having a basis weight in a range of 14 to 20 pounds per ream where a ream comprises 3000 square feet.

In one embodiment of the invention, the metal foil layer has a basis weight in a range of 10 to 55 pounds per ream, where a ream comprises 3000 square feet.

In one embodiment of the invention, the metal foil layer has a thickness of 1 mil or less.

In one embodiment of the invention, the metal foil layer has a thickness of no greater than 0.5 mils.

In one embodiment of the invention, the paperboard comprises white paperboard having a basis weight in a range of 90 to 350 pounds per ream where a ream comprises 3000 square feet, and the heat sealant coating is solvent-based.

In one embodiment of the invention, the composite layer structure comprises:

1) Al foil having a basis weight of 10 to 55 pounds per ream
2) White paperboard having a basis weight of 90 to 350 pounds per ream
3) Solvent-based heat sealant coating having a basis weight of 2.5 to 4 pounds per ream
4) Lamination adhesive having a basis weight of 1 to 2 pounds per ream, where a ream comprises 3000 square feet.

In one embodiment of the invention, the paperboard comprises brown paperboard having a basis weight in a range of 150 to 550 pounds per ream where a ream comprises 3000 square feet, and the heat sealant coating is solvent-based.

In one embodiment of the invention, the composite layer structure comprises:

1) Al foil having a basis weight of 10 to 55 pounds per ream
2) Brown paperboard having a basis weight of 150 to 550 pounds per ream
3) Solvent-based heat sealant coating having a basis weight of 2.5 to 4 pounds per ream 4) Lamination adhesive having a basis weight of 1 to 2 pounds per ream, where a ream comprises 3000 square feet.

In one embodiment of the invention, the paperboard comprises white paperboard having a basis weight in a range of 185 to 440 pounds per ream where a ream comprises 3000 square feet, and the heat sealant coating is resin-based.

In one embodiment of the invention, the composite layer structure comprises:

1) Al foil having a basis weight of 10 to 55 pounds per ream
2) White paperboard having a basis weight of 185 to 440 pounds per ream
3) Resin-based heat sealant coating having a basis weight of 14 to 20 pounds per ream
4) Lamination adhesive having a basis weight of 1 to 2 pounds per ream, where a ream comprises 3000 square feet.

In one embodiment of the invention, the paperboard comprises brown paperboard having a basis weight in a range of 295 to 695 pounds per ream where a ream comprises 3000 square feet, and the heat sealant coating is resin-based.

In one embodiment of the invention, the composite layer structure comprises:

1) Al foil having a basis weight of 10 to 55 pounds per ream
2) Brown paperboard having a basis weight of 295 to 695 pounds per ream
3) Resin-based heat sealant coating having a basis weight of 14 to 20 pounds per ream
4) Lamination adhesive having a basis weight of 1 to 2 pounds per ream, where a ream comprises 3000 square feet.

In one embodiment of the invention, the total liner thickness is in a range of 11 mils to 110 mils.

In one embodiment of the invention, the total liner thickness is in a range of 12.6 to 14.8 mils.

In one embodiment of the invention, the paperboard layer has a thickness in a range of 12 to 14 mils; the metal foil layer has a thickness in a range of 0.35 to 0.5 mils; and the heat sealant is a solvent-based heat sealant coating having a thickness in a range of 0.2 to 0.3 mils.

In one embodiment of the invention, the liner further includes an adhesive boding the paperboard layer to the metal foil layer.

In one embodiment of the invention, the paperboard layer comprises wood fiber or other cellulose fiber.

In one embodiment of the invention, the paperboard layer is comprised of greater than 80% cellulosic fiber.

In one embodiment of the invention, the paperboard layer has a thickness range of 10 to 100 mil (0.010 to 0.100 inch); the metal foil layer has a thickness range of 0.25 to 3.5 mil (0.00025 to 0.0035 inch); and the heat sealant is a heat seal coating having a thickness in a range of 0.2 to 6 mil (0.0002 to 0.006 inch).

BRIEF DESCRIPTION OF THE DRAWINGS

There is shown in the drawings one or more exemplary embodiments, it being understood however, that the invention is not limited to the specific articles and methods disclosed. Additionally, like reference numerals represent like items throughout the drawings.

FIG. 5 is a chart showing repulping test data for white paperboard (white paper) and brown paperboard (brown paper) backed foil seal liners, utilizing Al foil and a solvent-based heat sealant coating, according to various embodiments of the invention;

FIG. 6 is a chart showing repulping test data for white paperboard (white paper) and brown paperboard (brown paper) backed foil seal liners, utilizing Al foil and a resin-based heat sealant coating, according to various embodiments of the invention.

DETAILED DESCRIPTION

Figure 2:
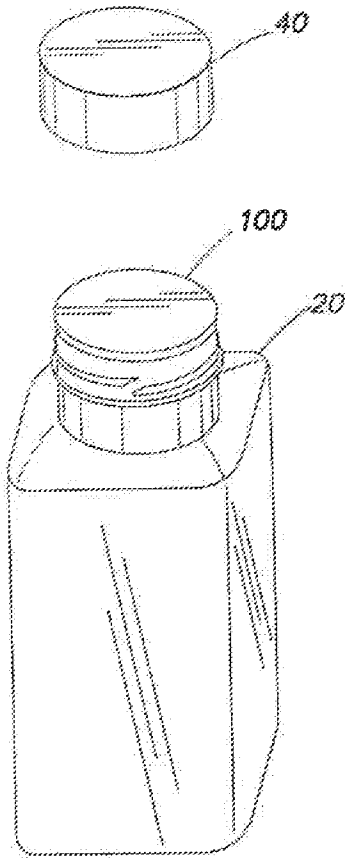
FIG. 2 is a front perspective view similar to FIG. 1, showing the liner now attached (induction heat sealed) to the mouth of the container.
Figure 1:
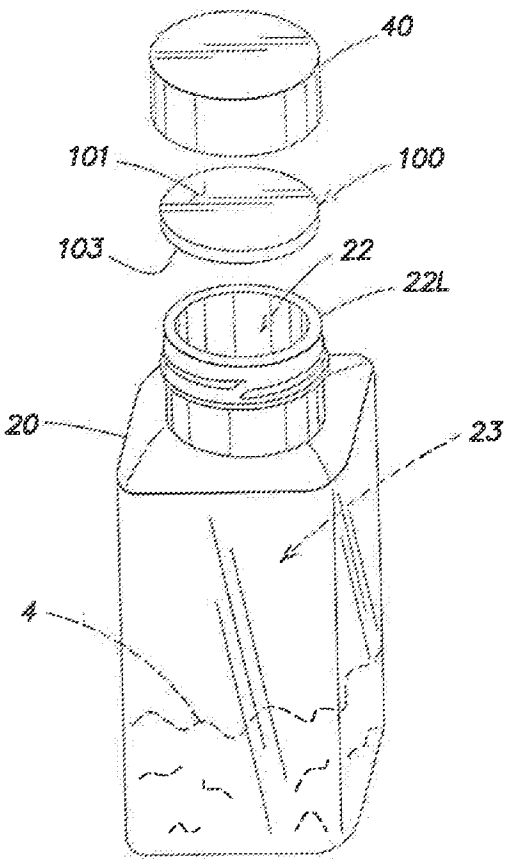
FIG. 1 is a front perspective view of an induction heat sealable multi-layer liner, positioned between a mouth of a container (holding a product) and a removable threaded cap, in accordance with one embodiment of the invention.
Figure 3:
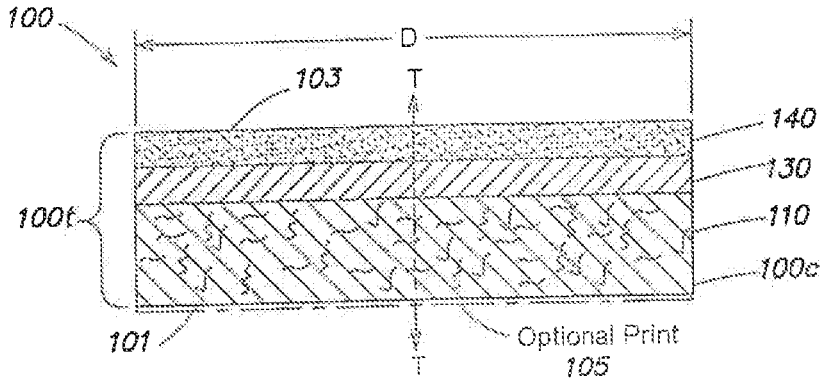
FIG. 3 is a cross-sectional schematic view of the multi-layer liner of FIG. 1, now showing the various layers.

Referring to FIGS. 1-3, there is shown an induction heat seal liner 100 that is fully recyclable in a paper recycling stream in accordance with one embodiment of the present invention. The liner is configured to be sealed over an opening or mouth 22 to an internal chamber 23 of the container holding a product or substance 4. A removable closure or cap 40 (here a threaded cap) is then applied over the liner and sealed opening of the container.

The liner 100 may be used on a variety of containers for holding various food, cosmetic, confectionery, household and other products in the form of liquid, solid or paste (semi-solid) substances 4. The container is typically made of plastic, but may be glass, molded fiber/pulp, or metal (e.g., aluminum).

The liner 100 has an integral one-piece multi-layer construction having a liner thickness 100*t* in a direction T transverse to opposing top planar surface 101 and bottom planar surface 103 respectively (as shown in FIG. 3). The liner includes in serial order form top to bottom: a top paperboard layer 110, a middle layer of metal (here aluminum) foil 130 for inductive heating, and a bottom heat seal layer 140. It should be noted that more or fewer layers, or layers of other materials than listed herein, may be used without departing from the present invention, as long as the total liner structure satisfies the repulping and paper recycling stream requirements as recited herein. For example, adhesives, other bonding materials, and coatings may be provided between the layers 110/130/140. Alternatively, one or more layers may include printed information or designs, e.g., in the form of a varnish or coating with inks or dyes. In one embodiment (see FIG. 3) a printed or informational layer 105 is provided on the outermost top surface of the liner, above the paperboard layer 110 and facing the consumer when the closure is removed from the sealed container.

The container 20 is filled with a product 4 through the opening 22 (or through another orifice of the container that communicates with the chamber 23) and the liner 100 is sealed around the opening 22, allowing the customer to remove the cap 40 and peel off the liner 100 to access the product. The liner 100 can be used with different types of containers 20 and different types of closures or caps 40, such as a threaded cap (FIGS. 1-2), a snap-closed or flip-top cap, or other types of caps known in the industry. In the embodiment of FIGS. 1-2, the liner 100 is heat seal bonded at its lower-most (bottom) surface 103 to an annular (circumferential) lip 22L of the container 20 surrounding the opening 22, and the cap 40 is closed (threaded) thereover.

In one embodiment, the paperboard layer thickness 110*t* and/or metal layer thickness 130*t* of the liner eliminates any need for a further barrier layer, membrane or material to be laminated to the liner, while preventing access, leakage, and contamination through the liner.

In the present embodiment, the liner 100 is a generally disc-shaped (circular) article having a diameter D, with parallel and opposing top 101 and bottom 103 planar faces each with a matching circular circumference 100*c*, and a transverse liner thickness 100*t* which is relatively thin compared to the diameter D (note in FIG. 3 the liner thickness and diameter are not shown to scale, as the liner thickness 100*t* would more typically be on the order of 0.2 to 2% of the liner diameter D). In one embodiment, the total liner thickness 100*t* is in a range of 11 mil (0.011 inch) to 110 mil (0.110 inch) and the liner disk diameter D in the range of 15 mm (0.59 inch) to 150 mm (5.90 inch) A mil is a unit of length equal to one thousandth of an inch (0.0254 millimeter).

Figure 4:
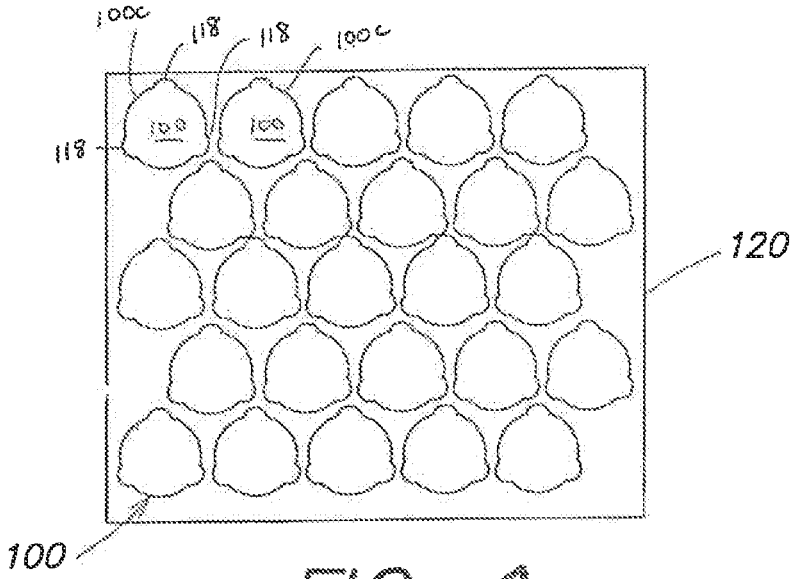
FIG. 4 is a top plan view of a sheet or web including multiple liners in accordance with one embodiment of the invention.

In one embodiment, the liner 100 includes one or more tabs 118 around the circumferential edge 100*c* (see FIG. 4 showing a sheet 120 with multiple tabbed liners 100). This is not meant to be limiting, as no tabs, a single tab and/or other shapes of liner may be used. For example, an oval or rectangular liner may be provided to seal an oblong or rectangular opening or mouth, without departing from the present invention.

The liner 100 is affixed by a heat seal bond (via bottom heat seal coating 140) to an area (here annular lip 22L) around the opening 22 of the container 20, thus completely covering and sealing around the opening. The liner can then later be peeled off (by the ultimate purchaser/consumer) to access the contents 4 of the container. Typically, the liner 100 can be peeled off using a fingernail or, in embodiments having a tab 118, by grasping the tab between the thumb and forefinger to facilitate removal of the liner 100 from the opening 22 of the container 20.

In some embodiments the heat seal bond layer 140 may be limited to a perimeter area of the liner, as this is all that is required for sealing around the opening of the container. In other embodiments, the heat sealant layer may cover additional surface areas and/or the entire lowermost surface 103 of the liner or lidding.

In one embodiment, the thicknesses in the transverse direction T of the paperboard layer 110 and/or of the metal foil layer 130 do not permit venting (the release of gas from within the container to the exterior) to occur through the liner 100. Thus, the liner 100 is a non-venting liner. More particularly, the metal and paper layers area of the liner 100 do not permit a free flow of air or gas from inside the container 20 to the outside of the container 20, or vice versa.

The container 20 may be composed of any materials capable of providing a tamper evident, removable induction heat seal secured to the container and that are suitable for storage of the substance being sold. It may also provide barrier properties as desired. The container 20 may be composed of a polymer material, for example of polyethylene PE, polypropylene PP, polyethylene terephthalate PET or polyvinyl chloride PVC. In another embodiment, the container 20 is glass, molded fiber/pulp, or metal (e.g., aluminum). Once the liner 100 has been secured over the opening 22 of the container 20, a removable cap 40 is secured to the container 20 over the liner 100.

The barrier properties of the liner 100, measured e.g., in terms of oxygen transmission rates (OTR) or moisture vapor transmission rates (MVTR)) can be controlled by adjusting (reducing or increasing) the materials and dimensions of the various layers in the liner 100. In the present embodiment, the required barrier properties of the sealed container are maintained by the paper layer(s) 110 and metal layer 130.

FIG. 4 illustrates one embodiment of a web or sheet of bulk liner material 120 from which a plurality of individual liners 100 are cut or punched. Web 120 is assembled as a one-piece, multi-layer sheet prior to partially punching the liners 100 from the web sheet. The web 120 is made from a plurality of individual sheets 110/130/140 stacked one atop the other in the T direction to form an integral liner sheet material 120. Alternately, if desired, liners can be made from strips of multi-layered materials, mounted on reels that are fed through a punching machine to die cut or punch the seal.

As used herein, the paper or paperboard layer 110 is a sheet of cellulose material, including those materials typically used in the liner industry and referred to as paper, paperboard, board and pulp. The sheet may comprise wood fiber or other cellulose fibers, and may further include fillers, binders, chemical treatment and surface coatings, and may be made of virgin or recycled materials.

The paperboard layer 110 may be a sheet comprising a heterogeneous mixture of plant material such as cellulose, hemi-cellulose, lignin, etc. and filling material such as china clay, calcium carbonate, etc., chemical additives such as rosin, alum, starch, etc. depending on the grade of the paper. Typically, the paperboard layer is comprised of greater than 80% cellulosic fiber, together with one or more binders, optical brighteners, coatings and/or other chemicals.

In various embodiments, the thicknesses of the respective layers may comprise:

- a paperboard layer in a thickness range of 10 to 100 mil (0.010 to 0.100 inch);
- a metal (e.g., aluminum) foil layer of 0.25 to 3.5 mil (0.00025 to 0.0035 inch);
- a heat seal coating of 0.2 to 6 mil (0.0002 to 0.006 inch).

The liner of the present invention provides a simple, cost-effective solution that will allow consumers to recycle the entire liner 100 in a paper recycling stream. As a result, manufacturers currently selling products without liners will now be able to include liners on their containers and provide a totally recyclable container package, including the container, cap and liner (each recyclable in a respective plastic or paper recycling stream), while providing the benefits that liners provide, including maintaining product integrity and barrier properties, extending shelf life, providing tamper evidence, preventing leakage, preventing products from being contaminated and/or damaged by consumers sampling the products, and/or otherwise creating an un-saleable product due to leakage, contamination or damage.

Non-Paper Components

The composition, structure and amount of the non-paper components of the liner are controlled in order to achieve both repulpability and recyclability. In general, these materials are considered contaminants in the paper recycling stream, and may degrade the repulping process (interfere with grinding, rewetting or the filtering process) so as to lower the pulp yield.

The amount of metal foil in the liner structure must be limited. While depending on the overall liner dimensions and other layer thicknesses, a suitable thickness for the foil layer is generally 1 mil or less.

The film layers in one embodiment are limited to the paperboard layer and the metal foil layer. Additional film layers (e.g., either as heat sealant film or barrier film) if used should be of a thickness no greater than 50 gauge (0.0005 mils or 12 microns) and of characteristics that do not negatively impact the repulping operation, i.e., create undue difficulty in grinding the structure and/or difficulty in blending (for pulping). An adhesive coating (e.g., to bond the metal foil layer to the paper board layer) and a heat sealant coating (to bond the liner to the container rim) are allowed, as they are sufficiently thin (as described herein on a basis weight) so as not to substantially interference with the repulping and recycling processes.

A typical solvent-based heat sealant (HS) (known as a universal sealant) can be used as a coating for sealing the liner to bottles made of polyethylene, polyester, and/or polypropylene. Ethyl Acetate (EA) is a suitable solvent carrier, as are Methyl Ethyl Ketone (MEK), and/or a mix of EA and MEK. Depending on the coating chemistry, a suitable solvent carrier is water (aqueous).

Resin-based heat sealant (HS) coatings can also be a universal sealant (i.e., for sealing to various bottles made of polyethylene, polyester, polypropylene, and even glass). The resin-based heat sealant coating can be co-extruded in one or more coating steps (as long as the basis weight remains as required for the repulping in relation to the overall liner basis weight, pulp basis weight, and Al foil basis weight for the liner structure are met). For example, for a 20 lbs./ream basis weight of the resin-based HS coating, this can be a co-extruded structure of 12 lbs./ream of ethyl vinyl acetate (EVA) and 8 lbs./ream of ethylene acrylic acid (copolymer resin) where EVA is the heat sealant contact surface to the bottle and the EAA helps create a stronger bond to the Al foil during the application of the HS coating to the foil by the means of resin extrusion (i.e., known as co-extrusion of two resins). The resin-based coating can be applied by other methods such as slot die resin-coating.

FIG. 5: Solvent-Based HS Coating

FIG. 5 illustrates suitable ranges of basis weight for paperboard (also referred to as paper), either white paperboard or brown paperboard, where the paperboard comprises at least 85% of the total liner weight for white paperboard, or at least 90% by total liner weight for brown paperboard, in combination with the remaining non-paper components of the liner being up to 15% by total liner weight for a white paperboard-based liner, and up to 10% by total liner weight for a brown paperboard-based liner, respectively. As shown in FIG. 5, the non-paper components are an aluminum (Al) foil layer, a solvent-based heat sealant (HS) coating, and a lamination adhesive (to bond the Al foil to the paperboard) in order to yield, after repulping the entire liner, the desired at least 80% by weight of pulp for a white paperboard-based liner, or at least 85% by weight of pulp for a brown paperboard-based liner. The liner structure in the present embodiment comprises in serial order: paperboard/laminating adhesive/Al foil/solvent-based heat sealant coating. The repulping and recycling test protocols are set forth below under the section heading "Repulping and Recycling Test Protocols".

For a white paperboard-based liner with a solvent-based HS coating the basis weight ranges of materials are:

1). Al foil basis weight: 10 to 55 pounds per ream
2). White paperboard basis weight: 90 to 350 pounds per ream
3). Solvent-based heat sealant coating basis weight: 2.5 to 4 pounds per ream
4). Lamination adhesive basis weight: 1 to 2 pounds per ream For a brown paperboard-based liner with a solvent-based HS coating the basis weight ranges of materials are:

1). Al foil basis weight: 10 to 55 pounds per ream
2). Brown paperboard basis weight: 150 to 550 pounds per ream
3). Solvent-based heat sealant coating basis weight: 2.5 to 4 pounds per ream
4). Lamination adhesive basis weight: 1 to 2 pounds per ream FIG. 6: Resin-Based HS Coating FIG. 6 illustrates suitable ranges of basis weight for paperboard (also referred to as paper), either white paperboard or brown paperboard, where the paperboard comprises at least 85% of the total liner weight for white paperboard, or at least 90% by total liner weight for brown paperboard, in combination with the remaining non-paper components of the liner being up to 15% by total liner weight for a white paperboard-based liner, and up to 10% by total liner weight for a brown paperboard-based liner, respectively. As shown in FIG. 6, the non-paper components are an aluminum (Al) foil layer, a resin-based heat sealant (HS) coating, and a lamination adhesive (to bond the Al foil to the paperboard) in order to yield, after repulping the entire liner, the desired at least 80% by weight of pulp for a white paperboard-based liner, or at least 85% by weight of pulp for a brown paperboard-based liner. The liner structure in the present embodiment comprises in serial order: paperboard/laminating adhesive/Al foil/resin-based heat sealant coating. The repulping and recycling test protocols are set forth below under the section heading "Repulping and Recycling Test Protocols".

For a white paperboard-based liner with a resin-based HS coating the basis weight ranges of materials are:

1). Al foil basis weight: 10 to 55 pounds per ream
2). White paperboard basis weight: 185 to 440 pounds per ream
3). Resin-based heat sealant coating basis weight: 14 to 20 pounds per ream
4). Lamination adhesive basis weight: 1 to 2 pounds per ream For a brown paperboard-based liner with a resin-based HS coating the basis weight ranges of materials are:

1). Al foil basis weight: 10 to 55 pounds per ream
2). Brown paperboard basis weight: 295 to 695 pounds per ream
3). Resin-based heat sealant coating basis weight: 14 to 20 pounds per ream
4). Lamination adhesive basis weight: 1 to 2 pounds per ream Repulping Process The entire paperboard-based composite liner structure is subject to a repulping process which includes grinding, blending and disintegration in order to determine a weight percentage of repulpable paper material, i.e., to achieve a pulp yield of at least 80% by weight of the paperboard layer for white paperboard and at least 85% by weight of the paperboard layer for brown paperboard, such that the total composite liner structure is recyclable in a paper recycling stream. Large non-paper components such as aluminum foil and beat sealant are removed by filtering (through a screen). Ink particles are removed by washing and flotation. The pulp yield (accept rate of at least 80% by weight of the paperboard layer) is then measured by weight. The test protocols for repulping and the recycling are more specifically described in the following section.

Repulping and Recycling Test Protocols

The following repulping and recycling test protocols can be used in accordance with the present invention. These test protocols were established by a joint alliance of the Fibre Box Association (FBA) and the American Forest & Paper Association (AF&FPA) which issued a "Voluntary Standard For Repulping and Recycling Corrugated Fiberboards Treated to Improve Its Performance in the Presence of Water and Water Vapor" (publicly available at www. Fibrebox.org, revised Aug. 16, 2013). Western Michigan University (WMU) has a WMU Paper Pilot Plant, 4651 Campus Drive, Kalamazoo, MI 49008, USA, which is one of several certified laboratories for conducting the repulping and recycling test protocols.

Voluntary Standard for Repulping and Recycling Corrugated Fiberboard Treated to Improve its Performance in the Presence of Water and Water Vapor, Revised Aug. 16, 2013

INTRODUCTION

Disposing of treated corrugated that cannot be recycled can be a financial and logistical burden on the supply chain for these packages. While treated corrugated containers are the most practical and cost-effective way to ship produce, meats, seafood and other items, certain treatments to improve performance in the presence of water or water vapor have made recycling difficult. It is desirable from both increased recyclable fiber availability and environmental standpoints to encourage the development of treated corrugated that may be recycled into other paper products using common mill technology.

The corrugated products industry recognizes the solution to this problem should be industry-wide, primarily because the recycling mills cannot effectively identify all treatments specific to particular companies. Different treatment systems may have different impacts on recycling processes; mill operators have even considered some to be highly detrimental.

To address and evaluate the technical as well as the educational aspects of this objective, a joint committee was formed consisting of the Fibre Box Association and the American Forest & Paper Association (AF&PA) members who represented manufacturers of containerboard, corrugated containers, and others who utilize recovered corrugated container fiber. Their work was to evaluate the repulpability and recyclability of moisture barrier treatments or coatings applied to liners or combined corrugated board in an effort to establish a minimum threshold for moisture barrier treated or coated corrugated that is intended, and labeled, to be recyclable into new containerboard and other paper products.

After numerous meetings, tests, and legal reviews, the committee developed this Voluntary Standard for repulpability and recyclability. The Standard contains a test method and test report. Box manufacturers can register treatments and coated board combinations with the Fibre Box Association if they do the following:

Have a lab approved by the FBA (3$^{rd}$ party or internal) certify that treatment has passed the test protocol.

Forward the completed Test Report, lab certification, and required samples to the FBA.

Provide a copy of the Company and Material Information Forms (pages 13-15 of this document) to the FBA signed by an officer of their company.

Once the "Treatment" Registration letter is received by the applicant, follow the marking guidelines as called for in the protocol.

For additional information, call:

Fibre Box Association (FBA):
25 Northwest Point Blvd. Suite 510
Elk Grove Village, IL 60007
847-364-9600
Fax 847-364-9639
www.fibrebox.org Purpose 1. The application of this Voluntary Protocol is only for "linerboard (including Kraft Paper), corrugating medium, combined board, and corrugated products made from these materials, collectively known as "corrugated fiberboard". The purpose is to encourage the development of treatments to corrugated fiberboard that will provide water resistance or some other desirable characteristic that are repulpable and recyclable, and will replace existing treatments that also provided water resistance or some other desirable characteristic, but did not allow the corrugated fiberboard to be repulpable or recyclable. The goal is to return to the OCC stream corrugated fiberboard that formerly was not accepted into that stream.
2. This standard establishes a repeatable method for simulating a commonly used subset of repulping and recycling processes. It is intended to evaluate the impact of repulping and recycling treated corrugated fiberboard on containerboard mill operations and final products.
3. This standard establishes a method for identifying treated corrugated that can be repulped and recycled in this selected subset of processes. It establishes minimum levels of performance for the handsheets made from treated corrugated, repulped and recycled in accordance with a detailed test protocol given in Appendices A & B. This standard is not intended to preclude the development or use of any technological advances in mill or treatment processes. It is intended to encourage the development, use and repulping and recycling of treated corrugated products for use in high-moisture environments.

Scope

1. This standard applies repulping and recycling process technology either in effect or readily achievable in mills currently involved in recycling.
2. This standard establishes a screening method to determine the repulpability and recyclability of treated corrugated products that have not previously been considered recyclable.
3. The test method in this standard has two parts:

Part 1 determines the repulpability of treated corrugated by determining fiber-on-fiber yield when only the treated corrugated is processed in accordance with this standard (Appendix A).

Part 2 determines the recyclability of the treated corrugated by evaluating its effect on mill operations and finished products when it is added to untreated corrugated in the amounts specified (Appendix B).

4. This voluntary standard does not relieve the user from compliance with all applicable local, state and federal laws and regulations, and contractual agreements.

5. This standard is not intended to address the functionality or marketability of the treated corrugated or of mill products that use the treated corrugated as a fiber source.
6. This standard does not address all of the factors that should be considered in the development of a repulpable and recyclable treatment. The companies that develop treatments and treated corrugated and test them under this standard are responsible for making sure that, in addition to being repulpable and recyclable, the products will be safe and suitable for their intended applications—e.g., packaging in contact with food- and will not create other non-desirable environmental effects at the point of use or disposal.
7. Treated corrugated containers recovered for recycling should not be contaminated by their contents, such as hazardous or perishable materials.

Definitions of Key Terms

Fiber-on-fiber yield is the amount of fiber that remains after the processing action, expressed as a percentage of the fiber present in the material to be tested.

Handsheets are sheets made from a suspension of fibers in water in an operation, whereby each sheet is formed separately by draining the pulp suspension on a stationary sheet mold.

OCC (Old Corrugated Containers) is a grade of waste paper comprised of untreated corrugated boxes that have been used for the purpose for which they were originally purchased and have subsequently been source separated from other waste.

Recyclable means used paper, including in-plant and post-consumer waste paper and paperboard, which is capable of being processed into new paper or paperboard using the process defined in this standard.

Recyclability test sample consists of a minimum of 20% (by weight) of the treated corrugated to be tested and the remainder of the untreated corrugated.

Repulpable means the test material that can undergo the operation of re-wetting and fiberizing for subsequent sheet formation, using the process defined in this standard.

Treated corrugated is the combined board or boxes that have been subjected to a specific treatment for the purpose of improving its performance in the presence of water or water vapor. The level of treatment used in the test must be equal to or greater than the level of treatment to be used in the field.

Untreated corrugated/control is the same combined board or boxes that have not been subjected to any treatment to improve performance in the presence of water or water vapor.

Test Method

Preliminary Analysis: Before beginning the test protocol, determine the moisture content of the treated corrugated sample.

Part 1: Repulpability

Figure 7:
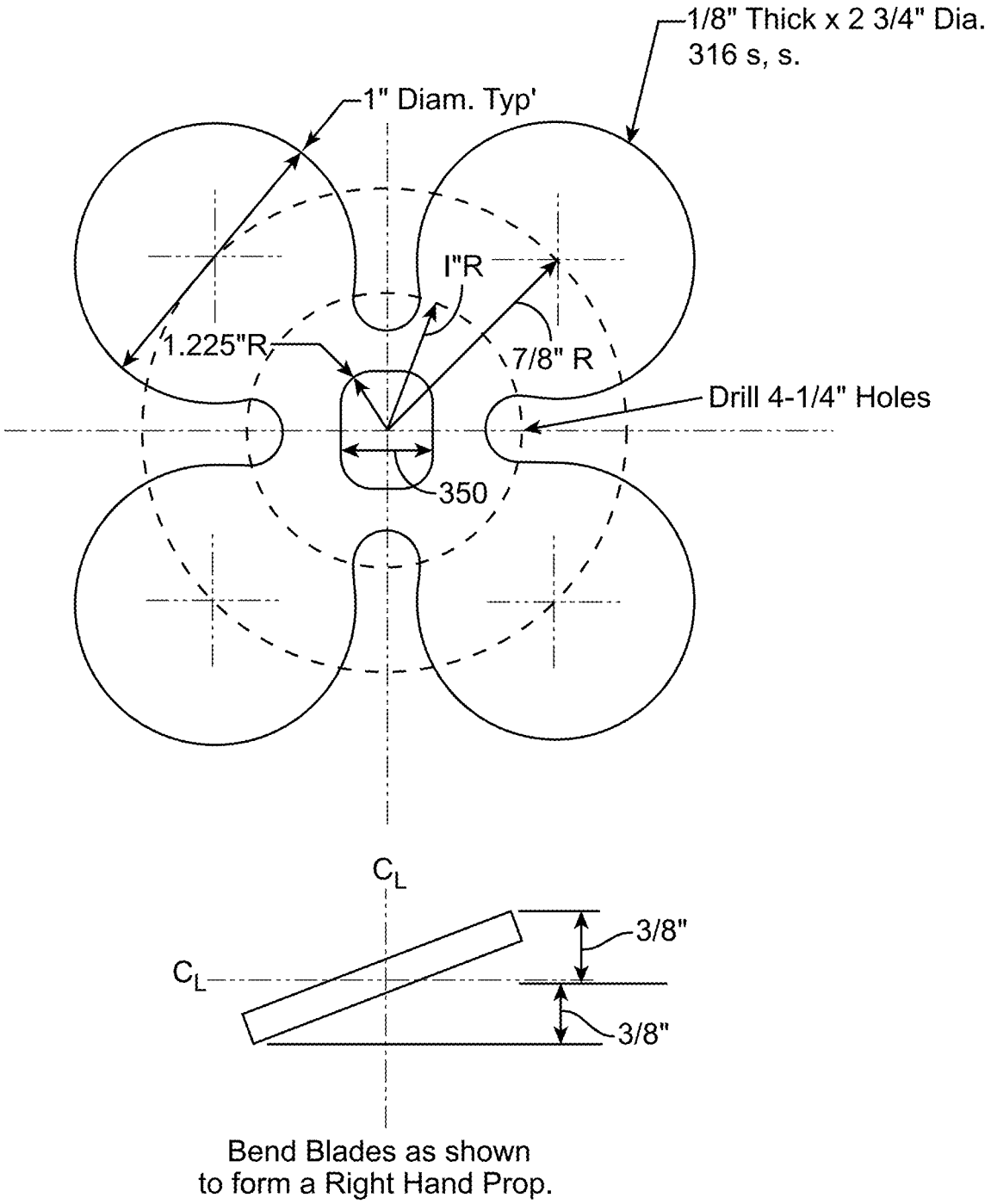
FIG. 7 is a schematic drawing of a Waring Blender Special Propeller for use in the Voluntary Standard for Repulping and Recycling as set forth herein.

A 100% charge of treated corrugated is repulped in a Modified Waring Blender (as shown in FIG. 7) and a British Disintegrator in water at a pH of 7 (±0.5 pH) that is maintained at 125° F. (±10°) following the procedure outlined in Appendix A. The pulped material is separated in a screen with 0.010-inch or smaller slots to determine fiber recovery as a percentage of the amount of fiber charged. Detailed procedures for repulpability are given in Appendix A.

Part 2: Recyclability

Mix a minimum of 20% treated corrugated and the remainder of the same untreated corrugated in a laboratory-scale pulper at pH 7 (±0.5 pH) and 125° F. (±10°). This is the recyclability test sample. As a control, a charge of 100% of the same untreated corrugated is also pulped using identical conditions. Each pulped material is passed through (in succession) a pressure screen equipped with a basket with 0.062 inch holes, the same screen or a similar screen equipped with a basket with 0.010 inch slots and a reverse centrifugal separator under conditions specified in the procedure Handsheets (3.0 gram) are made from the final stage (cleaner) accepts. For each batch tested, the handsheets are pressed and dried with heat and tested for product performance properties. Properties include slide angle, short span compressive strength (STFI), bursting strength and water drop penetration, using the established TAPPI official test methods. Appearance tests shall be done according to the procedure outlined in Appendix B. The final sheets shall have no more than 15 spot counts, or not exceeding 30% greater counts than the control, with an area of ≥0.4 $mm^2$ area, averaged over 3 sheets. The properties and appearance of the handsheets from the recyclability test sample and untreated corrugated tests will be compared. Detailed procedures for recyclability are given in Appendix B.

Part 3: Performance Levels

Treated corrugated satisfying all of the requirements of the voluntary standard will be regarded as repulpable and recyclable. There are three general performance requirements: fiber yield, operational impact and product requirements.

Fiber yield from the repulpability test must be at least 80% based on the total weight, or 85% based on the bone dry fiber charge to the pulper.

Operational impact is acceptable if:

1. The entire procedure can be completed without using an acid wash to clean the flat screen in the Repulpability Test or dismantling the pressure screens to clean them before finishing the Recyclability Test, and
2. There is no visible deposition on any part of the disintegrator during the Repulpability Test or in the pulper during the Recyclability Test.

Product requirements are satisfied if:

1. The appearance of the handsheets made from the recyclability test sample shows no substantial difference from that of the handsheets made from the control and the spot count is ≤15 counts, or not exceeding 30% greater counts than the control, with an area ≥0.4 $mm^2$, averaged over 3 sheets.
2. The decrease in the slide angle of the handsheets (the average of five first slides) made using the recyclability test sample from the slide angle of the handsheets made from the control must be no greater than 15%.
3. STFI and burst strength of the handsheets made using the recyclability test sample, normalized to the sheet basis weight, must show no more than a 10% decrease from the respective values for the control. All test results are to be reported in English units.
4. The water drop penetration of handsheets made from the recyclability test sample must not exceed the water drop penetration of the control handsheets by more than 200 seconds.

Certification and Marking (Self-Certification)

1. Tests for Parts 1 and 2 are repeated twice. For each set of tests, the results for the first treated sample must be compared to the results for the first untreated sample tested. Similarly, the results of the second treated sample must be compared to the results of the second untreated sample. If the recyclability test sample passes all tests on both trials, it satisfies the standard. If it passes all tests on one trial, but fails some on the other, it may be retested in a third trial. The recyclability test sample must pass all tests in the third trial to satisfy the standard.

2. Manufacturers of treated corrugated or corrugated treatments may self-certify their own product by using any capable laboratory, working in accordance with the detailed protocol provided in this standard. The laboratory may be internal to the company or a third party laboratory. All laboratories (internal and third party) shall certify that their facilities and equipment are suitable for testing the tendered product within the instructions and tolerances of this standard.
3. Treated corrugated must be recertified if there is any significant change in treatment product, substrate chemistry or any increase in the ratio of treatment to fiber. Minor modifications to a treatment material, which do not affect the water resistance or the repulpability/recyclability of the treated boxes, will not require recertification. However, if the chemistry of the treatment material is changed such that the water resistance is increased or the repulpability/recyclability of treated containerboard could reasonably be expected to be more difficult, the treatment material has to be recertified. The substrate chemistry will be considered to have been changed, requiring recertification, if wet strength chemicals, a high level of sizing chemicals or other chemicals significantly affecting the repulpability of the substrate (which were not used in the original certification test) are used in conjunction with the previously approved treatment product.

Note: Conventional wet strength linerboard and corrugating medium, by definition, is considered to be not repulpable/recyclable unless it has passed the tests in this Voluntary Standard. Wet strength containerboard may not be substituted for standard kraft or recycled containerboard without being re-certified at a lab and re-registered with the FBA. Conventional water resistant corrugating adhesives may be substituted for lower grades of moisture resistant or domestic corrugating adhesive; however, the substitution of proprietary or special corrugating adhesives with known extra water resistance would require recertification by a lab and re-registration with the FBA.

4. Once a treatment material has been approved at one location, it does not have to be recertified to be used at another location, if it is applied at the previously approved, or lower, treatment-to-fiber ratio and is applied on standard kraft or recycled containerboard. All locations of the company registering the treatment material may use the treated material without further registration, as long as the treatment-to-fiber ratio is not exceeded and it is applied on standard kraft or recycled containerboard.

However, if a different company purchases treated containerboard or treatment chemicals, or performs production functions on purchased sheets, or markets treated materials under the name of a company that has not registered the use of these treated materials, that company must register their use of these treated materials with the FBA. The same restrictions regarding not exceeding the treatment-to-fiber ratio and the application on standard kraft or recycled containerboard continue to apply. Companies selling registered treatments or treated materials to companies that will be re-selling previously registered treatments or treated materials are required to provide sufficient technical information so that the company purchasing the treatments and/or the treated containerboard for resale can comply with the treatment-to-fiber ratio maximums and that the application is on standard kraft or recycled containerboard. (See the "Option B" registration procedure on pages 13-14 of this document.)

Multiple trade names may be used for the same registered treatment as long as the treatment is applied or the treated materials are combined so that the previously approved, or lower, treatment-to-fiber ratio is not exceeded and the application is on standard kraft or recycled containerboard. All trade names for a given registered treatment or treated material must be reported to the FBA on a continuing basis with additions, deletions, and changes reported within 30 days of implementation. Identical trade names may not be used for different registered treatments or treated materials. However, a common "Family Name" with varying prefixes and/or suffixes is allowed.

The objective of having all sellers of registered treatments or treated materials report all relevant trade names is to allow the FBA to know who is producing treatments and treated materials and how they may be identified in the marketplace. This information is critical to permit the FBA to facilitate tracing any complaints from containerboard mills back to a box plant.

5. Marking

If the repulpable/recyclable certification marking (as shown below) is used, it must clearly appear on the box with the box manufacturer's name and location.

See Appendix D for guidelines on use of this symbol.

Figure 8:
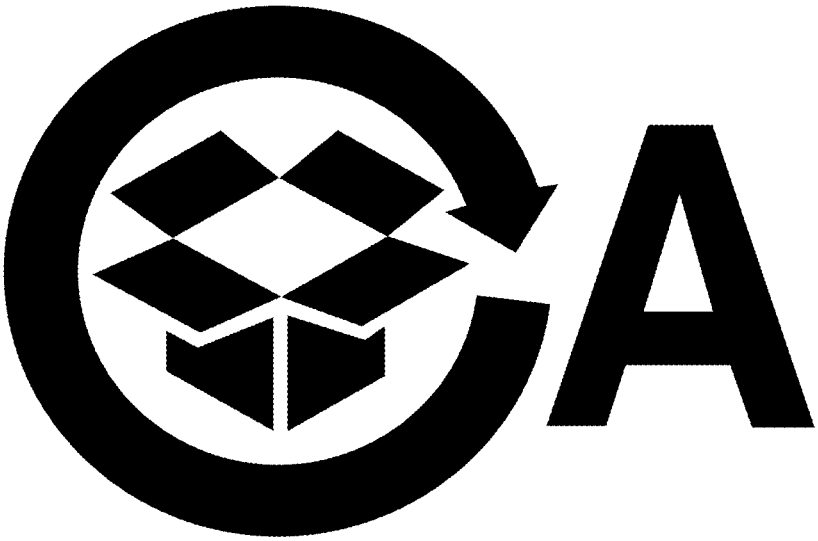
FIG. 8 is a schematic drawing of a Modified Corrugated Recycles Symbol as set forth in Appendix D of the Voluntary Standard for Repulping and Recycling as set forth herein.

Modified Corrugated Recycles Symbol (See FIG. 8)

Samples

1. In addition to common basis weights and except for the treatment(s), to the extent possible, control and treated samples should be made as alike as possible. (e.g. common rolls of containerboard for non-treated components, consecutive corrugated runs, etc.)
2. Because of differences in pilot plant equipment, test labs will each have their own sample size, quantity, etc. requirements. Consult with your test lab to understand their sample submission parameters.

Appendix A: Repulpability Test Procedure

Purpose

To determine the repulpability of corrugated board. (Note that the Repulpability Test must be run at least twice on the treated corrugated board. The sample must pass two out of three tests.)

Apparatus

Specimen Cutting Device

Balance (accurate to 0.01 gram)

Waring Blender (with special blade, labeled FIG. 1) (FIG. 7 herein)

Hot Water 125° F. 10° F. (52° C. 5° C.)

British Disintegrator (Standard Apparatus for Pulp Evaluation No. 270)

Open Flat Screen 10 Cut (0.010"), such as the Valley or Somerville screens

Aluminum Weighing Pans

Laboratory Oven at 221° F. (105° C.)

Specimen Testing

1. Cut corrugated board into 1¼ in. (31.8 mm) by 4 in. (102 mm) strips.
2. Weigh out 0.055 lb. (25 gm.) of corrugated board.
3. Place sample in 1500 ml. of water at 125° F.±10° F. (52° C.±3° C.).[1]
4. Preheat blender and British disintegrator to 125° F.±10° F.
5. Blend in a one-gallon Waring blender (equipped with special blades) on low speed (15,000 rpm) for four minutes.
6. Rinse all fibers from the blender with 500 ml. of hot water.
7. Deflake for five minutes in the British disintegrator (2000 ml. total volume) at 3000 rpm.
8. Run on 0.010" (0.254 mm) slotted open flat screen, maintaining 1" water head, for 20 minutes; save the accepts and rejects in aluminum weighing pans.
9. Dry in a laboratory oven for 12 hours (±4 hours) at 221° F. (105° C.).
10. Weigh the pans and record the net weight of accepts, rejects, and the sum of the accepts and rejects.

Calculation $$\% \text{ of Rejects} = \frac{\text{Net Rejects} \times 100}{\text{Net Accepts} + \text{Net}}$$

Report

Percentage of rejects to the nearest 0.1%

Appendix B: Recyclability Test Procedure

Note: Both the Control sample and the sample of Treated and Untreated test material must be tested at least twice and must pass two out of three tests.

1. Obtain a sample of the treated corrugated to be evaluated. From this sample, select a sufficient amount of material for the test. The selection should be as representative as possible of the material as a whole. Also obtain a sufficient amount of untreated corrugated to run the protocol. Selection of the charge size will depend upon the capacity of the pilot plant pulper to be used. Pulping is to be carried out at 3% consistency, or, at the consistency recommended by the pulping equipment manufacturer.
2. Determine the moisture content [TAPPI T 412]. Perform steps 3 through 9 twice-once with the untreated "control" sample, once with the "recyclability test sample."
3. Use selected sample materials of any convenient size, but no smaller than 1×1 inch square. Bring the equipment to 125° F. (±10°). Adjust the pH of the charge so that after pulping the pH will be equal to 7 (±0.5 pH). Raise the temperature of the pulper to 125° F. (±100). Charge the pulper and pulp for 15 minutes while maintaining 125° F. (±10°).
4. Repeat step 3 until sufficient material has been obtained for the following steps. Maintain the temperature of the pulp at 125° F. (±10°) until it is used in step 5.
5. Combine the pulp from several batches, as necessary, and dilute to the manufacturer's recommended consistency with water heated to 125° F. (±10°). Adjust the pH to 7 (±0.5 pH). Preheat a screen with 0.0625 inch holes to 125° F. (±10°) and maintain the temperature throughout this screening step. Pass the pulp sample through the preheated screen at a volumetric reject rate of 10% of the feed rate or at appropriate volumetric reject rate based on manufacturer's specifications or recommendations.
6. With the accepts from step 5, repeat the procedure in step 5, using a screen basket with 0.010 inch slots, again maintaining the temperature, consistency and a 10% reject rate or at a rate based on manufacturer's specifications.
7. Pass the accepts from step 6 through a lightweights reverse centrifugal-type cleaner, maintaining the temperature at 125° F. (±10°), consistency, and the pressure differential specified for the cleaners being used. Determine the volumetric reject rate and report.
8. From the accepts from step 7, form handsheets according to TAPPI T 205 with the following conditions:
   The slurry should be vigorously agitated (without causing a change in fiber distribution in the slurry) and maintained at 125° F. (+10°) and pH 7 (+0.5 pH).
   Dry the sheets under restraint to 7% moisture content on a surface dryer maintained at 250-275° F.
   Recondition to TAPPI standard conditions prior to testing.

Test the handsheets for:
   Basis Weight [TAPPI T220]
   Slide Angle [TAPPI T 815]
   Short Span Compression (STFI) [TAPPI T 826]
   Bursting Strength [TAPPI T 403]
   Water Drop Penetration [TAPPI T 831]

Note 1. The Slide Angle test on the handsheets is to be tested blotter side to blotter side. Note 2. The Water Drop Penetration test is to be conducted with five (5) drops each on the wire side and the blotter side of the handsheets.

Note 3. Basis Weight, STFI, Bursting Strength and the Indexed Value are to be reported in English units.
9. If the test must be halted to clean any post pulping apparatus in any aspect of the procedure, note your observations on the test report.
10. Report the results using the form provided (Appendix C).

Handsheet Preparation for Stickies/Spot Count Test

1. Plug in Carver press and pre-heat top and bottom platens to 350° F.
   Caution: use gloves and wear safety glasses when using Carver press the plates get very hot and can burn you.
2. Dilute test stock to approximately 1% consistency.
3. Form and dry a 500 ml check sheet.
   Couch off the excess water with two blotters, the round metal plate, and the roller.
   Dry on top of a new blotter in the speed dryer.
4. Weigh the handsheet and mark its identification and dry weight on the topside of the handsheet (not the wire side).
5. Calculate the amount of slurry to use for test sheets using the following formula:

2.00 grams÷dry sheet weight×500=mis of slurry to use for test sheets.

6. Form 3 handsheets for testing by using the calculated amount of slurry.
7. Place sheets on blotters and dry on the speed dryer, then mark their identification on the topside of each sheet.
8. Remove test sheets from the speed dryer (drying period is 3-5 minutes).
9. Place each test sheet between filter paper and blotters in the following configuration (bottom to top):

Blotter
Filter
Stickie Sheet
Filter
Blotter

10. Set the stacks of test sheets on top of each other and press them in the pre-heated Carver press for five minutes at 350° F. and 500 psi. Watch to see that the pressure gauge maintains 500 psi.

11. Remove the test sheets from the Carver press and weigh each sheet.
Record dry weight on each sheet 12. Count the spots in the handsheets that are ≥0.4 $mm^2$ in area using any appropriate analysis tools, such as the dirt count estimator in TAPPI T-537 or the image analysis system mentioned in TAPPI T-277 and TAPPI T-563.

The Voluntary Standard (as described above) can be used for both white paperboard-based liners and brown paperboard-based liners as defined herein. The white paperboard structure is also referred to as SBS, which stands for Solid Bleached Sulfate (one of the types of white paperboard). For Part I, the Repulpability Process, a minimum pass/fail limit is 80% accepts, 20% rejects. For Part II, the Recycling Process, the pulper loading is 85% control material (white or brown paperboard itself) and 15% test material (complete liner according to the invention).

While the invention has been described and illustrated in various terms and embodiments, the scope of the invention is not intended limited thereby and other modifications or embodiments as may be suggested by the teachings herein are particularly reserved as they fall within the scope of the appended claims.

The invention claimed is:

1. An induction heat-sealable closure liner or lidding configured for recycling in a paper recycling stream, the liner or lidding having a composite layer structure comprising:

a paperboard layer;

a metal foil layer for inductive heating; and a heat sealant coating;

wherein the paperboard layer is white paperboard or brown paperboard, for white paperboard the paperboard layer has a pulp weight of at least 85% by weight based on the total weight of the composite layer structure, and for brown paperboard the paperboard layer has a pulp weight of at least 90% by weight based on the total weight of the composite layer structure the remaining weight percent of the composite layer structure comprising the metal foil layer and heat sealant coating are such that the total composite layer structure is recyclable in a paper recycling stream, wherein repulping of the composite layer structure achieves a pulp yield of at least 80% by weight of the paperboard layer for white paperboard and at least 85% for brown paperboard, the metal foil layer has a basis weight in a range of 10 to 55 pounds per ream, where a ream comprises 3000 square feet, and the metal foil layer has a thickness of 1 mil or less.

2. The induction heat-sealable closure liner or lidding of claim 1, wherein:

the heat sealant layer comprises one or more of: a solvent-based heat sealant coating, a water-based heat sealant coating, or a resin-based heat sealant coating that is melted to form the coating.

3. The induction heat-sealable closure liner or lidding of claim 1, wherein:

the heat sealant coating is a solvent-based heat sealant coating having a basis weight in a range of 2.5 to 4 pounds per ream where a ream comprises 3000 square feet.

4. The induction heat-sealable closure liner or lidding of claim 1, wherein:

the heat sealant coating is a resin-based heat sealant coating having a basis weight in a range of 14 to 20 pounds per ream where a ream comprises 3000 square feet.

5. The induction heat-sealable closure liner or lidding of claim 1, wherein:

the metal foil layer has a thickness of no greater than 0.5 mils.

6. The induction heat-sealable closure liner or lidding of claim 1, wherein:

the total liner thickness is in a range of 11 mils to 110 mils.

7. The induction heat-sealable closure liner or lidding of claim 1, wherein:

the total liner thickness is in a range of 12.6 to 14.8 mils.

8. The induction heat-sealable closure liner or lidding of claim 1, wherein:

the paperboard layer has a thickness in a range of 12 to 14 mils;

the metal foil layer has a thickness in a range of 0.35 to 0.5 mils; and the heat sealant is a solvent-based heat sealant coating having a thickness in a range of 0.2 to 0.3 mils.

9. The induction heat-sealable closure liner or lidding of claim 1, wherein the liner further includes an adhesive boding the paperboard layer to the metal foil layer.

10. The induction heat-sealable closure liner or lidding of claim 1, wherein:

the paperboard layer comprises wood fiber or other cellulose fiber.

11. The induction heat-sealable closure liner or lidding of claim 1, wherein:

the paperboard layer is comprised of greater than 80% cellulosic fiber.

12. The induction heat-sealable closure liner or lidding of claim 1, wherein:

the paperboard layer has a thickness range of 10 to 100 mil;

the metal foil layer has a thickness range of 0.25 to 1 mil; and the heat sealant is a heat seal coating having a thickness in a range of 0.2 to 6 mil.

13. The induction heat-sealable closure liner or lidding of claim 1, wherein:

the paperboard comprises white paperboard having a basis weight in a range of 90 to 350 pounds per ream where a ream comprises 3000 square feet, and the heat sealant coating is solvent-based.

14. The induction heat-sealable closure liner or lidding of claim 13, wherein:

the composite layer structure comprises:

1) Al foil having a basis weight of 10 to 55 pounds per ream

2) White paperboard having a basis weight of 90 to 350 pounds per ream

3) Solvent-based heat sealant coating having a basis weight of 2.5 to 4 pounds per ream
4) Lamination adhesive having a basis weight of 1 to 2 pounds per ream, where a ream comprises 3000 square feet.

15. The induction heat-sealable closure liner or lidding of claim 1, wherein:

the paperboard comprises brown paperboard having a basis weight in a range of 150 to 550 pounds per ream where a ream comprises 3000 square feet, and the heat sealant coating is solvent-based.

16. The induction heat-sealable closure liner or lidding of claim 15, wherein:

the composite layer structure comprises:

1) Al foil having a basis weight of 10 to 55 pounds per ream
2) Brown paperboard having a basis weight of 150 to 550 pounds per ream
3) Solvent-based heat sealant coating having a basis weight of 2.5 to 4 pounds per ream
4) Lamination adhesive having a basis weight of 1 to 2 pounds per ream, where a ream comprises 3000 square feet.

17. The induction heat-sealable closure liner or lidding of claim 1, wherein:

the paperboard comprises white paperboard having a basis weight in a range of 185 to 440 pounds per ream where a ream comprises 3000 square feet, and the heat sealant coating is resin-based.

18. The induction heat-sealable closure liner or lidding of claim 17, wherein:

the composite layer structure comprises:

1) Al foil having a basis weight of 10 to 55 pounds per ream
2) White paperboard having a basis weight of 185 to 440 pounds per ream
3) Resin-based heat sealant coating having a basis weight of 14 to 20 pounds per ream
4) Lamination adhesive having a basis weight of 1 to 2 pounds per ream, where a ream comprises 3000 square feet.

19. The induction heat-sealable closure liner or lidding of claim 1, wherein:

the paperboard comprises brown paperboard having a basis weight in a range of 295 to 695 pounds per ream where a ream comprises 3000 square feet, and the heat sealant coating is resin-based.

20. The induction heat-sealable closure liner or lidding of claim 19, wherein:

the composite layer structure comprises:

1) Al foil having a basis weight of 10 to 55 pounds per ream
2) Brown paperboard having a basis weight of 295 to 695 pounds per ream
3) Resin-based heat sealant coating having a basis weight of 14 to 20 pounds per ream
4) Lamination adhesive having a basis weight of 1 to 2 pounds per ream, where a ream comprises 3000 square feet.

* * * * *